US005404566A

United States Patent [19]

Wehrmeyer

[11] Patent Number: 5,404,566

[45] Date of Patent: Apr. 4, 1995

[54] PROCESS FOR GENERATING AN ENTERTAINMENT AUDIO SIGNAL INTERRUPTED BY ADVERTISING AUDIO SIGNALS AND DEVICE FOR CARRYING OUT THE PROCESS

[76] Inventor: Buckhard Wehrmeyer, Klopstockstrasse 17, 2300 Kiel, Germany

[21] Appl. No.: 721,595

[22] PCT Filed: Nov. 29, 1990

[86] PCT No.: PCT/DE90/00915

§ 371 Date: Sep. 30, 1991

§ 102(e) Date: Sep. 30, 1991

[87] PCT Pub. No.: WO91/08625

PCT Pub. Date: Jun. 13, 1991

[30] Foreign Application Priority Data

Nov. 29, 1989 [DE] Germany ..... 39 39 484.0

[51] Int. Cl.[6] ..... H04H 1/02

[52] U.S. Cl. ..... 455/6.3; 455/45; 455/103; 381/81; 381/77; 269/3; 269/7; 269/47

[58] Field of Search ..... 381/81, 80, 77, 107; 455/18, 66, 45, 6.3, 4.1, 4.2, 103; 360/12, 72.3; 369/3, 7, 28, 47; 358/84; 348/1, 9

[56] References Cited

U.S. PATENT DOCUMENTS

| | | | |
|---|---|---|---|
| 3,409,738 | 11/1968 | Heald et al. | 381/107 X |
| 3,659,059 | 4/1972 | Ivy | 369/3 |
| 3,696,297 | 10/1972 | Otero | 455/4.2 |
| 3,922,607 | 11/1975 | Wysong | 455/45 |
| 4,197,496 | 4/1980 | Hiyama | 455/16 |
| 4,305,101 | 12/1981 | Yarbrough et al. | 360/69 |
| 4,520,404 | 5/1985 | Von Kohorn | 358/335 |
| 4,616,271 | 10/1986 | Yasukawa et al. | 381/107 |
| 4,636,880 | 1/1987 | Debell | 360/72.3 |
| 4,656,629 | 4/1987 | Kondoh et al. | 370/85 |
| 4,868,866 | 9/1989 | Williams, Jr. | 380/49 |
| 5,133,081 | 7/1992 | Mayo | 369/7 |
| 5,155,591 | 10/1992 | Wachob | 358/86 |

FOREIGN PATENT DOCUMENTS

| | | | |
|---|---|---|---|
| 8778298 | 3/1988 | Australia | 455/6.3 |
| 4006930 | 9/1991 | Germany | 369/7 |
| 0042613 | 3/1984 | Japan | 369/3 |
| 0254835 | 12/1985 | Japan | 369/7 |
| 0017243 | 1/1986 | Japan | 369/7 |

*Primary Examiner*—Robert J. Pascal
*Assistant Examiner*—Arnold Kinkead
*Attorney, Agent, or Firm*—Dykema Gossett

[57] ABSTRACT

A process for generating an entertainment audio signal interrupted by advertising audio signals in which pilot signals associated with the advertising audio signals cause switching between the entertainment audio signals and the advertising audio signals makes it possible to broadcast different radio programs of the desired acoustic quality in a shop by means of a carrier frequency. To this end, a high-frequency control signal is generated from advertising audio signals and pilot signals which precede or follow the advertising audio signals. The control signal and preferably the entertainment audio signal are modulated to a high-frequency carrier signal, possibly with several channels, for the separate recovery of the signals. The modulated carrier signal is transmitted, the transmitted carrier signal is demodulated and, if necessary, the signals are separated from each other. The pilot signals of the transmitted control signals are monitored for the presence of fading or flashback conditions. If fading conditions are present, an advertising audio signal forming part of the control signal which follows the pilot signal is faded over the supplied entertainment audio signal and the resultant signal is reproduced. If flashback conditions are present or if the advertising audio signal is interrupted for a certain time interval, the entertainment audio signal is faded in and the resultant signal is reproduced.

11 Claims, 2 Drawing Sheets

Figure 1:
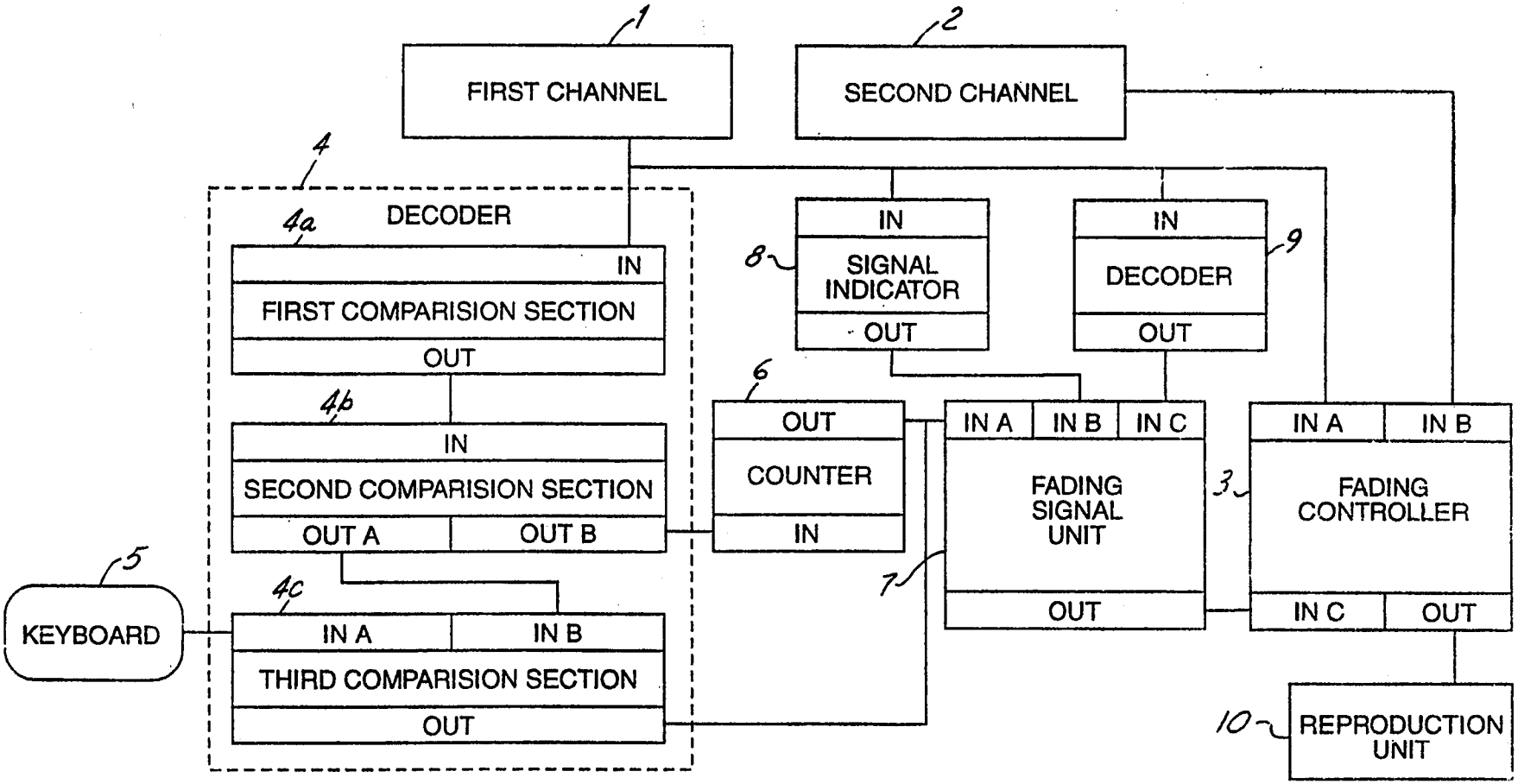

PROCESS FOR GENERATING AN ENTERTAINMENT AUDIO SIGNAL INTERRUPTED BY ADVERTISING AUDIO SIGNALS AND DEVICE FOR CARRYING OUT THE PROCESS

The present invention relates to a process for generating an entertainment audio signal interrupted by advertising audio signals in which pilot signals associated with the advertising audio signals cause switching between the entertainment audio signals and the advertising audio signals, and to a device for carrying out the process. Process and device according to the invention may be utilized in commercial establishments, such as department stores or supermarkets, for the pleasure of the customers therein and for increasing sales of definite articles and services.

Known audio performances in shops include two components, an entertainment or music program and different commercials which shortly interrupt or blot out the entertainment program, and which announce e.g. special offers. These different programs are not broadcasted by one central transmitter. In each commercial establishment, the entertainment program and the commercials are played by two different tape recorders. This includes the disadvantage that a relatively expensive distribution system is necessary to supply the commercial establishments with cassettes having the actual entertainment and advertising programs.

Such a tape-reproduction device is described in the German Gebrauchsmuster 19 88 049 comprising a time switch arrangement which causes that a first cassette comprising a music program is switched off and a second cassette comprising the commercials is switched on. A switching back to the starting condition is controlled by a distance marker on the tape of the second Cassette, by means of modulation or timing pulses. For the user, only the advertising program on the cassettes is available. Further, the apparatuses cannot be programmed such that the reproduction of individual stored commercials can be suppressed or not suppressed and the volume of reproduction is not adjustable.

To broadcast a radio program for commercial establishments from a station via satellite, radio or cable is only profitable due to the high costs for renting a carrier frequency if at least 10 to 15 different chains of shops can receive the program with the same frequency. On the other hand, different chains of shops want to broadcast different programs, especially to broadcast different commercials.

Further, it should be not advertised in an individual shop for an article which is sold out. In the other shops of the chain, this specific commercial should be further broadcasted. There is further a need for special commercials such as advertising programs for proprietary articles as known from radio which should be not suppressed since the companies pay for broadcasting their commercials in supermarkets. These "industry commercials" are alternatively broadcasted with so-called "special offer commercials". It should be guaranteed that the industry commercials are broadcasted in all shops having shop radio.

A simultaneously parallel broadcasting of different radio programs via one carrier frequency would be possible with a modulation such as used by the post office to transmit a plurality of telephone calls independently from each other via a cable. That process, however, leads to a significant reduction of the acoustic quality if 10 to 15 programs are transmitted.

The object of the invention is to provide a process and a device for generating an entertainment audio signal interrupted by advertising audio signals which allow broadcasting of different shop radio programs of the desired acoustic quality by means of a carrier frequency. With that, it should be possible to suppress broadcasting of different advertising programs, whereas it should not be possible to switch off broadcasting of preferable advertising programs.

The object is attained by an inventive process wherein a control signal is generated from advertising audio signals of shorter period and pilot signals which precede or follow the advertising audio signals, wherein the control signal and preferably the continuous entertainment audio signals are modulated to a high-frequency carrier signal, possibly with several channels for the separate recovery of the signals, wherein the modulated carrier signal is transmitted, wherein the transmitted carrier signal is demodulated and, if necessary, the signals are separated from each other, wherein the pilot signals of the transmitted control signal are monitored for the presence of fading or flashback conditions, wherein if fading conditions are present, an advertising audio signal forming part of the control signal which follows the pilot signal is faded over the supplied entertainment audio signal and the resultant signal is reproduced, and wherein if a flashback condition is present or if the advertising audio signal is interrupted for a certain time interval, the entertainment audio signal is faded and the resultant signal is reproduced.

With the process according to the invention, a single or multi channel control signal is at first generated from advertising audio signals and pilot signals, with preceding pilot signals having identification data for a following unified advertising program and following pilot signals possibly indicating the end of the unified commercial. A continuous single or multi-channel entertainment audio signal is simultaneously provided.

A high-frequency carrier signal is modulated with the control signal and preferably the entertainment audio signal, and preferably divided in several independent channels. This is possible without a significant influence on the transmission quality of advertising and entertainment audio signals. For example, a first channel only serves for the transmission of the entertainment audio signal whereas the control signal is associated with a second channel. All advertising programs, e.g. the offers and industry commercials of about 10 to 15 different shops or chains of shops, are sequentially supplied to the second channel. Alternatively, the control signal can be transmitted via a high-frequent carrier signal, and the entertainment audio signal can be available in the receiver in any way. Additional channels of the carrier signal can be added for multi-channel control signals and/or entertainment audio signals. Channels for the pilot signals, the advertising audio signals and different entertainment audio signals may be provided.

The following transmission of the modulated carrier signal may be carried out via satellite, radio or cable. Afterwards, the signals are separated from each other by demodulation of the carrier signal. This happens in the shops having shop radio.

Dependently from the preceding pilot signals, it is decided in the following if a preceding commercial is faded over the entertainment audio signal and if the resultant signal is transmitted. With that, fading conditions which can be complied with different pilot signals are regularly associated with each of the shops or a chain of shops to be supplied. Therewith, a specific shop radio program from the transmitted program can be associated with a shop or a chain of shops. The entertainment audio signal can be completely faded-out by the fade-over of the advertising program.

After the reproduction of a complete commercial, the entertainment audio signal is faded-in. Thereto, a pilot signal following the commercial can be monitored for the presence of a flashback condition or the interruption of the advertising audio signal for a certain time interval can be a criterion for the fade-in. The flashback condition can be identical in all shops or chain of shops to be supplied.

Fundamentally, the process is useful for the transmission of identical radio programs in all shops, with a rapid replacement of the programs being possible. However, it is especially advantageous that the pilot signals according to the process can include information which only allow the reproduction of following commercials in selected shops. The pilot signals can comprise further advantageous information, especially with respect to the possibility or non-possibility of switching off and/or the non-adjustability or adjustability of the volume of following commercial. Therewith, it is guaranteed that "industry commercials" can be neither switched off nor adjusted in the volume.

According to a further embodiment of the invention, the fading conditions can be partly suppressed. The suppressable fading conditions are associated with the pilot signals which precede the offer commercials (own commercials of the chain of shops) whereby these can be switched off. It is therefore possible to discriminate a predetermined commercial in a single shop of a chain of shops, e.g. if this commercial relates to a sold out article or service.

According to a further embodiment, the presence of pilot signals associated with non-suppressable fading conditions is counted. These pilot signals belong to industry commercials (radio programs of the advertising companies) whereby a control possibility is created for broadcasting these commercials in the individual shops.

For the technical realization of the process, it is especially advantageous if the pilot signal is a pilot audio signal or a sequence of pilot audio signals and if 10 to 15 different shop radio programs are transmitted. The different shop radio programs are characterized by different pilot audio signals or sequences of pilot audio signals which meet different shop-specific fading conditions, possibly the additional possibility exists for each shop to exclude predetermined parts of the program from reproduction by suppressing the fading conditions.

According to a further embodiment, the pilot signals of the transmitted control signal are monitored for the presence of storage conditions. If storage conditions are present, an advertising audio signal forming part of the control signal which follows the pilot signal is stored and preferably faded over the entertainment audio signal, and the resultant signal is reproduced. A stored advertising audio signal is faded over the supplied entertainment audio signal either according to a pilot signal of the control signal which meets the playing and fading conditions, or according to stored playing and fading conditions, and the resultant signal is reproduced. Playing and fading conditions are for example repeat time, possibility of influencing the volume, identification of commercials, possibility for switching-off, schedule for switching on. The advertising audio signal is faded instead of entertainment audio signal with the reproduction from the storage. With that, broadcasting time can be saved with commercials being frequently reproduced. The storing of playing and fading conditions cause an additional saving of broadcasting time since the transmission of pilot signals comprising such conditions is not necessary with each playing process.

A further embodiment provides, if further storage conditions are present, that a pilot signal having playing and fading conditions is present and stored. That allows a rapid and central replacement of the playing conditions.

For the technical realization of the process, it is particularly advantageous when the advertising audio signal to be stored is digitally transmitted and/or stored. The transmission can effectively occur via one or both channels, if separate channels are present for the advertising audio signal and the pilot signal.

Finally, the process provides that the storing of the advertising audio signal can be stopped according to a length information of the preceding pilot signal, a following pilot signal, an interruption of the advertising audio signal for a predetermined time interval and/or according to a regular time interval. By this, the storage space is used at a maximum.

A device according to the invention has a fading controller which is shifted from a passive mode in which the controller transmits an entertainment audio signal to a reproduction unit, to an active mode in which the controller transmits the advertising audio signal forming part of a control signal, faded over the entertainment audio signal, by means of a fading signal, and which is shifted back from the active mode to the passive mode by means of a flashback signal, a decoder having a comparison section which compares the pilot signal of the control signal with fading conditions, and which if the fading conditions are present generates a trigger signal, a fading signal unit which generates a fading signal between a trigger signal and a reset signal, and a flashback signal between a reset signal and a trigger signal, and a further comparison section of the decoder, which compares the pilot signal with a flashback condition, and which if a flashback condition is present, generates a reset signal, and/or a signal indicator which if the control signal is not present for a predetermined time interval generates a reset signal.

The functions of the device can be effected by the hardware or with the aid of an electronic data processing unit, such as a microcontroller. That is valid for all following embodiments.

An inventive device is especially characterized in that a fading controller has two inputs for control signals and entertainment audio signals separated from each other, and an output for coupling a reproduction unit that the fading controller has a control input, the fading controller being shifted from a passive mode in which the advertising audio signal is applied to its output to an active mode in which the advertising audio signal forming part of the control signal is faded over the entertainment audio signal at its output, by means of a fading signal being connected to the control input and the fading controller being shifted back from the active mode to the passive mode by means of a flashback signal being connected to the control input, that a decoder has an input for applying the control signal, at least one comparison section for comparing the pilot signal of the control signal with a fading condition, and an output being connected to the comparison section and if the fading condition is present carrying a trigger signal, that the output of the decoder is connected with an input of a fading signal unit which has a further input for a reset signal and which carries a fading signal between a trigger signal and a reset signal, and a flashback signal between a reset signal and a trigger signal, at an ouput being connected with the control input of the fading controller, and that the further input of the fading signal unit is connected with a further comparison section of the decoder to compare the pilot signal with a flashback condition, the further comparison section releasing a reset signal if a flashback condition is present, and/or that the further input of the fading signal unit is connected with an output of a signal indicator which has an input for the control signal and releases the reset signal at its outlet side if the control signal is not present for a predetermined time interval.

An inventive device is part of a shop radio system and e.g. is coupled with the outlet side of a receiver which demodulates the received carrier signal, and transmits the single or multi-channel control signals and entertainment audio signals separated from each other to the device. An amplifier and loudspeaker unit is connected to the device for reproducing the shop radio. In the passive mode, the fading controller transmits the applied entertainment audio signal to its output and therefore to the amplifier and loudspeaker unit. However, if a fading signal is applied to the control input of the fading controller, an advertising audio signal is faded over the entertainment audio signal, and the resultant signal is transmitted to the output. For that, the control signal is supplied to the input of a decoder which monitors using a comparison section if a received pilot signal meets the fading conditions and if the following advertising program should be faded-over. When the pilot signal meets a regular programmed code in the decoder, this decoder transmits a trigger signal on an output. The trigger signal is applied to an input of a fading signal unit which triggers the control input of the fading controller with a fading signal in dependence from each trigger signal and which causes the fading process. Since each device reacts on a plurality of pilot signals in the above described way, it is possible to trigger all devices individually or a plurality simultaneously via one pilot signal. Although the control signal permanently carries commercials for different addressees, the device only transmits such commercials to a reproduction unit, which should be broadcasted in the predetermined shop due to the individually associated fading conditions of the device. When the commercial has been reproduced and a signal indicator has been monitored the interruption of a control signal for a predetermined time interval, causes a reset signal to be released. A following pilot signal also causes a reset signal, to be released. Upon the generation of a release signal, the entertainment audio signal is again faded-in, i.e. it is supplied to the reproduction unit. For safety reasons, a following pilot signal can be used together with a signal indicator because possible interfering noises received by the signal channel may eventually prevent the shifting and, therefore, the following commercial would be heard in non-desired manner.

According to a preferable embodiment of the device, the decoder has a first comparison section for apparatus-specific fading conditions which allow the identification and reproduction of shop-specific parts of the shop radio program.

Additionally, the decoder may have a second comparison section for regularly programmed fading conditions, preferably coupled to the outlet side of the first comparison section. The comparison section always transmits trigger signals to the fading signal unit if one of its fading conditions is met so that associated industry commercials are always transmitted. Advantageously, a counter is provided, preferably at an output of the second comparison section which counts the trigger signals of the second comparison section and provides a control possibility for the reproduced industry commercials.

According to a further embodiment, the decoder has a third comparison section, preferably coupled to the outlet side of the first comparison section for freely selectable fading conditions, the third comparison section transmitting only then a trigger signal to the fading signal unit if a freely selectable fading condition is not suppressed. The decoder receives the freely selectable fading conditions preferably from a keyboard.

According to another embodiment, the decoder has a fourth comparison section which compares the pilot signal of the control signal with storage conditions and which, if the storage conditions are present, generates a recording signal. A storage is provided which stores the advertising audio signal which follows the pilot signal, in dependence on a recording signal, and possibly the playing and fading conditions of the pilot signal and which reads out a stored advertising audio signal to the fading controller in dependence on a playing signal. Further, the decoder has a fifth comparison section for monitoring a pilot signal or playing and fading conditions being read out the storage on playing conditions, with the fifth comparison section generating a playing signal according to the playing conditions. Therefore, predetermined pilot signals can trigger the storing of advertising audio signals and other pilot signals or stored playing and fading conditions can trigger the readout of stored advertising audio signals to the fading controller and the reproduction of the advertising audio signals by the reproduction unit.

The storage is preferably a digital storage which reads out the digitally stored advertising audio signal to the fading controller via a digital-analog converter. The digital storage preferably receives the digital advertising audio signal from an analog-digital converter connected to a head.

Preferably, the decoder is connected to a clock for monitoring time-dependent playing conditions.

The audio signal of the entertainment audio signal and/or the advertising audio signal is advantageously transmitted to the reproduction unit via an audio control which, if regularly programmed fading conditions are present, adjusts a predetermined volume level.

Preferably, the supplied pilot audio signal is transformed in a binary signal by a converter.

Finally, a filter can be connected before the reproduction unit, with the filter preventing a reproduction of the flashback pilot audio.

Further singularities and advantages of the subject matter of the invention are described according to the following description with reference to the accompanying drawings which show block circuits of two preferred embodiments of an inventive device. In the drawings FIG. 1 shows a device according to the invention which regards apparatus-specific regularly programmed and freely selectable fading conditions; and FIG. 2 shows a device having an additional storage.

Figure 2:
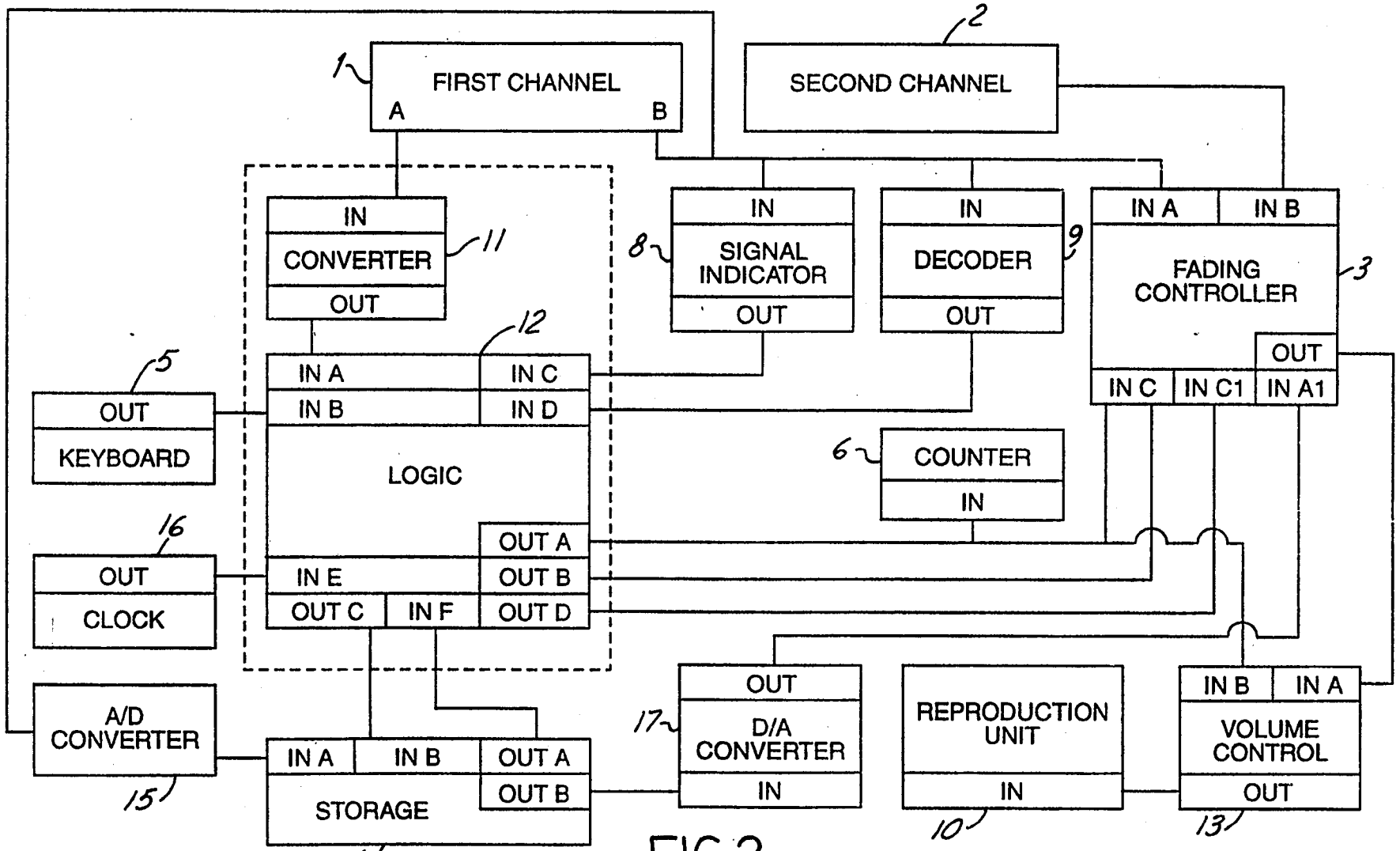

In the device according to FIG. 1, a control signal is applied to a first channel 1 whereas a second channel 2 carries an entertainment signal. A fading controller 3 is connected at its outlet side to a reproduction unit comprising an amplifier and loudspeakers. The control signal of the first channel 1 is applied to an input A of the fading controller 3 whereas the entertainment audio signal of the second channel 2 is charged into an input B of the fading controller.

The control signal of the first channel 1 is further applied to an input of a decoder 4 which has a first comparison section 4*a* for apparatus-specific fading conditions, with the output of the first comparison section being connected to an input of a second comparison section 4*b* for regularly programmed fading conditions. The output A of the second comparison section 4*b* is in turn connected to the input B of a third comparison section 4*c* for freely selectable fading conditions. A keyboard 5 for setting fading conditions is attached to a further input A of the third comparison section 4*c*. An output B of the second comparison section 4*b* is connected with an input A of a fading signal unit 7 via a counter 6. An output of the third comparison section 4*c* is connected to the input A of the fading signal unit 7.

The fading signal unit 7 has further inputs B and C which are connected to the output signals of a signal indicator 8 and a decoder 9, the output signals being charged with the control signal at the inlet side. On the outlet side, the fading signal unit 7 is coupled to a control input C of the fading controller which in turn is connected with a reproduction unit 10 at its outlet side.

The device operates as follows: In the passive mode, the entertainment audio signal transmitted from the second channel 2 to the input B of the electronic fading controller 3 is connected with the output of the fading controller and therefore transmitted to the reproduction unit 10. The control signal transmitted from the first channel 1 to the input A of the fading controller 3 is not connected to the output in the passive mode and therefore not reproduced.

The control signal transmitted from the channel 1 also arrives at the data decoder 4. The first section 4*a* compares the data of the pilot signal at first with the code being regularly programmed in the section and monitors if the following commercial is addressed to this definite device and with that assigned for broadcasting in the definite shop. Only if this is the case, the data block is transmitted to the second section 4*b*.

Now, the second section 4*b* monitors the received data block if the data are to be transmitted to the third section 4*c* via its output A as a disconnectable offer commercial follows or if a pulse is released via output B as a nondisconnectable industry commercial follows.

If a disconnectable offer commercial is present, the pilot signal is transmitted to the third section 4*c* via output A of the second section 4*b*. The third section monitors if the commercial has been released from the keyboard 5 or not. If the commercial has been released from keyboard 5, the third section 4*c* transmits via its output a pulse-like trigger signal to the fading signal unit 7 which shifts the device in the active mode.

The offer commercials can be therefore disconnected as they are numbered for a specific shop or a chain of shops. The shop staff is informed in writing if the numbering is changed in case of a change of the offers. A user can switch on or off the individual numbers of the offer commercials at the keyboard 5 of the device since the pilot audio preceding each commercial includes also this number.

When the second section 4*b* recognizes from the preceding pilot audio that the following commercial is an industry commercial, a pulse-like trigger signal is directly released from output B without the roundabout way over the third section 4*c*. This signal reaches the fading signal unit 7 via the counter 6. In this case, the device is also shifted to the active mode without a further verification and clearance by the third section 4*c*. Simultaneously, the industry commercials are counted independently from the offer commercials which run through the third section by the counter 6.

In difference to the offer commercials, the pilot audio which precedes the industry commercials does not include numbers but the information that the following commercial does not need a further clearance. The keyboard 5 has therefore no influence on broadcasting of the industry commercials.

The device is shifted to the active mode as long as the fading signal device 7 receives a pulse from the second section 4*b* or the third section 4*c* via its input A. Thereafter, the fading signal unit 7 transmits a signal to the electronic fading controller 3 which fades out the entertainment audio signal applied to its input B and transmits the advertising audio signal applied to its input A to its output and therewith to the reproduction unit.

The fading controller 3 maintains this mode as long as it receives the corresponding signal from the fading signal unit 7. From the signal indicator 8 and via the input B, the fading signal unit 7 receives the information if the commercial supplied to the first channel 1, still runs. When the commercial is finished, the fading signal unit 7 no longer receives a signal from the signal indicator 8. If the signal from the signal indicator 8 is interrupted for more than 3 seconds, the fading signal unit 7 stops its signal to the fading controller 3 so that the device is shifted back to the passive mode. Simultaneously, the following pilot signal reaches via a decoder 9 comprising a comparison section the input C of the fading signal unit 7 and causes the unit 7 to stop once more the signal to the fading controller 3 whereby the device is also then shifted to the passive mode if interfering noises reaches channel 1. The input A of the fading controller 3 is then separated from the output and the entertainment audio signal continuously applied to input B is again faded in and transmitted to the reproduction unit 10 via the output.

In the embodiment shown in FIG. 2, the parts equal to those of the embodiment described above are provided with the same reference numbers. Insofar, the figure references the above description. At 1, a stereo or mono signal is applied, and according to a first case, the channel A comprises pilot signals and the channel B advertising audio signals. According to a second case channels A and B comprise identical control signals of pilot signals and following advertising audio signals.

A converter 11 is connected to A, the converter transforming the received pilot audio signals into binary signals and transmitting these to a logic 12. The logic 12 meets the functions of the above described decoder 4 and the fading signal unit 7.

The logic monitors if the received data are intended for the addressee and if the commercial is an industry commercial or in the case of an offer commercial if a release is necessary from a keyboard 5. When the addressee is correct and a release is not necessary, a permanent fading signal (industry commercial on) is passed out via Out A. If a release is necessary and if this release is applied to In B from the keyboard 5, a permanent fading signal (offer signal on) is passed out via Out B. If a release is not present, a signal is not passed out.

If the advertising audio signal which is simultaneously applied to the signal indicator 8 via B is interrupted more than 3 seconds, the signal indicator transmits a reset signal to In C of the logic 12. A permanent fading signal applied to Out A or Out B of the logic 12 is then replaced by a reset signal whereby the device is shifted back in the passive mode. For shifting the fading controller from an active mode to a passive mode and vice versa, Out A and B are applied to a control input In C.

The switch between active and passive mode can also be caused by the decoder 9: It responds to a nonacoustic (high or low frequency) pilot signal and transmits a pulse-like reset signal to In D of the logic 12 so that the permanent fading signal applied to Out A or Out B is stopped and replaced by a reset signal, respectively. With that, resetting in the passive mode is possible without waiting for 3 seconds.

If 1 carries a stereo signal, the decoder 9 is not necessary: Instead, a permanent fading signal applied to Out A or Out B can be replaced by a reset signal by means of a following pilot audio and the logic 12. By this, the device is shifted to the passive mode without the need for waiting 3 seconds. In the stereo embodiment, the following pilot audio is non-acoustic since the audio cannot be transmitted from channel B through the fading controller 3 to the reproduction unit 10.

As described above, the entertainment audio signal is transmitted from 2 to In B of the fading controller 3. According to the switching mode, the audio signal reaches the reproduction unit 10 starting from an output Out. An interlocated volume control 13 can be adjusted by a user. However, if Out A of the logic 12 carries a permanent fading signal in case of an industry commercial, the signal also arrives at In B of the volume control 13. By this, a predetermined loudness level is adjusted which can be not altered by the user. Therefore, industry commercials are always reproduced with the same loudness.

In case a commercial of advertising audio signals is to be stored, the logic 12 recognizes that according to the preceding pilot audio and advises an input In B of a storage 14 via an output Out C to store the following advertising audio signal. The advertising audio signal arrives at In A of the storage 14 via an A/D converter 15.

If the preceding or following pilot audio contains playing conditions for the advertising audio signal to be stored, these conditions are transmitted from the logic 12 through its Out C to the storage 14 and stored therein.

The storing can be stopped according to a length information of the pilot signal by releasing a corresponding control signal from the logic 12 via its Out C to In B of the storage 14. The storing can be also stopped by a signal of the signal indicator 8 or the decoder 9 (also 3 seconds after the end of the commercial or by a non-acoustic switching off pilot signal). Finally, it is possible to stop the storing after a predetermined time interval.

For reading out of stored advertising audio signals, the storage 14 has stored regular time parameter as playing conditions which reach In F of the logic 12 from Out A of storage 14. The logic 12 then starts the storage 14 at predetermined times which are determined at In E of the logic by clock 16 by means of a playing signal transmitted from Out C to In B.

The reading out process can be also started by a further pilot signal by transmitting a playing signal from Out C of the logic 12 to In B of the storage 14. This pilot signal can comprise informations with respect to the advertising audio signal commercial which should be read out or only cause the read out of the next stored commercial.

The pilot signal or the stored signal can further comprise fading conditions (information if proprietary commercial or shop commercial). When the logic 12 expects a release as the playing and fading conditions ask for that (shop commercials), the logic 12 monitors the presence of the conditions by questioning the keyboard 5.

The same happens when the logic 12 learns from an inquiry from Out C to In B of the storage 14 that a corresponding playing and fading condition has been stored. The answer applies to Out A of the digital storage 14. Correspondingly, the logic 12 transmits a permanent fading signal to Out A (proprietary commercial) or to Out B (shop commercial with release from keyboard 5).

As far as the stored advertising audio signal is read out, the logic 12 at first transmits a fading signal to In C of the fading controller 3. The fading signal comes from Out A of the logic 12 if a proprietary commercial is read out, or from Out B of the logic if a shop commercial is read out. Simultaneously, the logic 12 transmits a fading signal from Out D to In C1 of the fading controller 3. Because of the additional fading signal at In C1 of the fading controller, this controller does not fade from its In B to In A but from its In B to In A1 wherein the stored advertising audio signal is read out via a D/A converter 17.

The logic 12 receives the information concerning the end of the advertising audio signal commercial, at its In F from Out A of the storage 14. The logic 12 then replaces the fading signals at Out A or at Out B and Out D with flashback signals which cause a backfading of the entertainment audio signals by means of the fading controller 3.

The counter 6 counts the permanent fading signals applied to its input, independently from the period of the signals. With that, the counter determines the number of the industry commercials.

I claim:

1. A process for generating an entertainment audio signal interrupted by an advertising audio signal in which pilot signals associated with the advertising audio signal cause switching between the entertainment audio signal and the advertising audio signal, comprising the steps of:

generating the entertainment audio signal;

generating a control signal including the advertising audio signal and the pilot signals;

modulating at least the control signal to a high frequency carrier signal;

transmitting the high frequency carrier signal;

demodulating the high frequency carrier signal into at least the control signal;

reproducing a resultant signal including one of the entertainment signal and the advertisement audio signal;

monitoring the control signal for a fading pilot signal, the presence of the fading pilot signal creating a fading condition wherein the advertising audio signal is faded over the entertainment audio signal before the reproducing step;

monitoring the control signal for a flashback pilot signal, the presence of the flashback pilot signal creating a flashback condition wherein the entertainment audio signal is faded over the advertising audio signal before the reproducing step; and including a non-suppressible fading condition, counting the non-suppressible fading condition using a counter.

2. A device for generating an entertainment audio signal interrupted by an advertising audio signal, comprising:

a reproduction unit;

a fading controller which is shifted from a passive mode in which the controller transmits an entertainment audio signal to the reproduction unit to an active mode in which the controller transmits the advertising audio signal forming part of a control signal and faded over the entertainment audio signal to the reproduction unit by means of a fading signal, and which is shifted back from the active mode to the passive mode by means of a flashback signal;

a first decoder having a comparison section which compares a pilot signal of the control signal with fading conditions and which if the fading conditions are present selectively generates a trigger signal;

the first decoder having an additional comparison section which compare a pilot signal of the control signal with regularly programmed fading conditions;

a fading signal unit which generates a fading signal between the trigger signal and a reset signal, and a flashback signal between the reset signal and the trigger signal; and a second decoder which compares the pilot signal with a flashback condition and which if a flashback condition is present generates the reset signal.

3. The device according to claim 2, including a counter which counts trigger signals of the additional comparison section.

4. The device according to claim 2, characterized in that the advertising audio signal is transmitted to the reproduction unit via an audio control which if regularly programmed fading conditions are present adjusts a predetermined volume level.

5. A device for generating an entertainment audio signal interrupted by an advertising audio signal, comprising:

a reproduction unit;

a fading controller which is shifted from a passive mode in which the controller transmits an entertainment audio signal to the reproduction unit to an active mode in which the controller transmits the advertising audio signal forming part of a control signal and faded over the entertainment audio signal to the reproduction unit by means of a fading signal, and which is shifted back from the active mode to the passive mode by means of a flashback signal;

a first decoder having a comparison section which compares a pilot signal of the control signal with fading conditions and which if the fading conditions are present selectively generates a trigger signal;

the first decoder having an additional comparison section which compares a pilot signal of the control signal with freely selectable fading conditions;

a fading signal unit which generates a fading signal between the trigger signal and a reset signal, and a flashback signal between the reset signal and the trigger signal; and a second decoder which compares the pilot signal with a flashback condition and which if a flashback condition is present generates the reset signal.

6. The device according to claim 5, characterized in that the additional comparison section receives the freely selectable fading conditions from a keyboard.

7. A device for generating an entertainment audio signal interrupted by an advertising audio signal, comprising:

a reproduction unit;

a fading controller which is shifted from a passive mode in which the controller transmits an entertainment audio signal to the reproduction unit to an active mode in which the controller transmits the advertising audio signal forming part of a control signal and faded over the entertainment audio signal to the reproduction unit by means of a fading signal, and which is shifted back from the active mode to the passive mode by means of a flashback signal;

a first decoder having a comparison section which compares a pilot signal of the control signal with fading conditions and which if the fading conditions are present selectively generates a trigger signal;

the first decoder having an additional comparison section which compares the pilot signal of the control signal with storage conditions and which if the storage conditions are present generates a recording signal, a storage being provided that stores the advertising audio signal which follows the pilot signal;

a fading signal unit which generates a fading signal between the trigger signal and a reset signal, and a flashback signal between the reset signal and the trigger signal; and a second decoder which compares the pilot signal with a flashback condition and which if a flashback condition is present generates the reset signal.

8. The device according to claim 7, characterized in that the storage is a digital storage which reads out a digitally stored advertising audio signal to the fading controller via a D/A converter.

9. The device according to claim 8, characterized in that the digital storage receives the digital advertising audio signal from an A/D converter.

10. The device according to claim 7, characterized in that the first decoder is connected to a clock.

11. A device for generating an entertainment audio signal interrupted by an advertising audio signal, comprising:

a reproduction unit;

a fading controller which is shifted from a passive mode in which the controller transmits an entertainment audio signal to the reproduction unit to an active mode in which the controller transmits the advertising audio signal forming part of a control signal and faded over the entertainment audio signal to the reproduction unit by means of a fading signal, and which is shifted back from the active mode to the passive mode by means of a flashback signal;

a first decoder which compares a pilot signal of the control signal with fading conditions and which if the fading conditions are present selectively generates a trigger signal;

a fading signal unit which generates a fading signal between the trigger signal and a reset signal, and a flashback signal between the reset signal and the trigger signal;

a second decoder which compares the pilot signal with a flashback condition and which if a flashback condition is present generates the reset signal; and a signal indicator that selectively generates the reset signal if the control signal is not present over a predetermined time interval.

* * * * *

UNITED STATES PATENT AND TRADEMARK OFFICE
CERTIFICATE OF CORRECTION

PATENT NO. : 5,404,566

DATED : April 4, 1995

INVENTOR(S) : Buckhard Wehrmeyer

It is certified that error appears in the above-identified patent and that said Letters Patent is hereby corrected as shown below:

Column 11, line 37, "compare" is changed to "compares".

Signed and Sealed this

Fourth Day of July, 1995

Bruce Lehman

*Attest:*

BRUCE LEHMAN

*Attesting Officer*

*Commissioner of Patents and Trademarks*